United States Patent [19]

Sporenberg et al.

[11] Patent Number: 4,866,967

[45] Date of Patent: Sep. 19, 1989

[54] APPARATUS FOR THE STRETCH LEVELLING AND SLITTING OF METAL STRIP

[75] Inventors: Willi Sporenberg; Karl Lefor, both of Hemer, Fed. Rep. of Germany

[73] Assignee: Sundwiger Eisenhutte, Maschinenfabrik Grah & Co., Hemer-Sundwig, Fed. Rep. of Germany

[21] Appl. No.: 273,715

[22] Filed: Nov. 17, 1988

Related U.S. Application Data

[63] Continuation of Ser. No. 69,446, filed as PCT EP86/00635 on Nov. 5, 1986, published as WO87/02604 on May 7, 1987, abandoned.

[30] Foreign Application Priority Data

Nov. 5, 1985 [DE] Fed. Rep. of Germany ..... 3539153

[51] Int. Cl.[4] ..... B21D 1/02

[52] U.S. Cl. ..... 72/129; 72/160; 72/203

[58] Field of Search ..... 72/129, 130, 160, 161, 72/203, 205; 83/18, 175

[56] References Cited

U.S. PATENT DOCUMENTS

| | | | |
|---|---|---|---|
| 3,338,208 | 8/1967 | Voss | 118/38 |
| 3,416,347 | 12/1968 | Walsh et al. | 72/203 |
| 3,416,347 | 12/1968 | Walsh et al. | 72/203 |
| 4,347,723 | 9/1982 | Bradlee | 72/130 |
| 4,558,578 | 12/1985 | Noé et al. | 72/203 X |
| 4,614,101 | 9/1986 | Fornataro | 72/203 X |

FOREIGN PATENT DOCUMENTS

| | | | |
|---|---|---|---|
| 0033065 | 8/1981 | Fed. Rep. of Germany . | |
| 465564 | 5/1937 | United Kingdom | 83/18 |

*Primary Examiner*—E. Michael Combs

*Attorney, Agent, or Firm*—Kerkam, Stowell, Kondracki & Clarke

[57] ABSTRACT

To obtain flat component strips from a cold-rolled metal strip inexpensively and with the minimum use of technical apparatus, slitting shears 5 are disposed between sets of tensioning drums 3, 4; 11, 12, more particularly between the inlet side set of tensioning drums 3, 4 and a straightening unit 6 of a stretch flattening apparatus for a metal strip 1. This arrangement of the slitting shears eliminates the additional stretch flattening of the component strips otherwise required after the metal strip itself has already been stretch flattened. The component strips between the two sets of tensioning drums 3, 4; 11, 12 also acquire the same length.

8 Claims, 1 Drawing Sheet

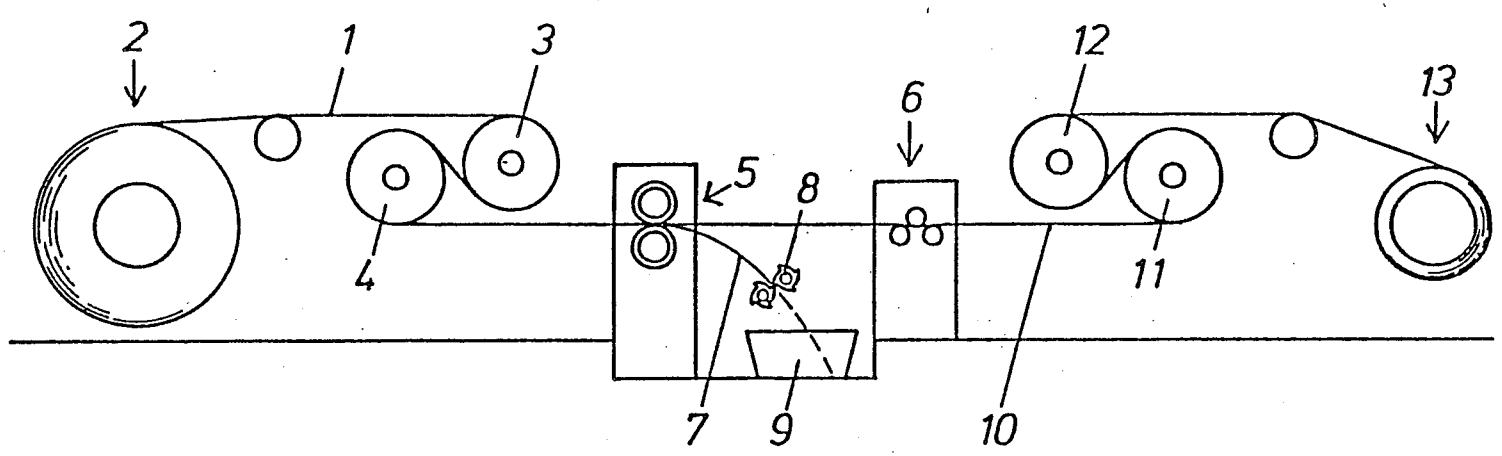
2
1
3
4
5
6
7
8
9
10
11
12
13

APPARATUS FOR THE STRETCH LEVELLING AND SLITTING OF METAL STRIP

This is a continuation of application Ser. No. 069,446, filed as PCT FP86/00635 on Nov. 5, 1986, published as WO87/02604 on May 7, 1987, abandoned.

The invention relates to an apparatus for the stretch flattening and longitudinal slitting of a metal strip, comprising inlet and outlet side sets of tensioning drums, between which the metal strip can be overstretched, the apparatus also comprising slitting shears and a recoiler.

A cold-rolled metal strip which is not subjected to an after-treatment will of course have uncontrollably distributed internal stresses, so that the strip 15 not flat. To obtain a strip of the required flatness, it must be stretch flattened by overstretching the strip between the two sets of tensioning drums. In the case of thicker strips a stretch to straightening unit for overstretching of the strip can also be disposed between the two sets of tensioning drums.

It is also known to subdivide the flat strip longitudinally into component strips after stretching flattening and to coil such component strips on a recoiler. However, splitting produces additional stresses in the component strips, and these lead to further unevennesses therein. To obtain flat component strips the strips must therefore be individually flattened in a further operation following slitting. This method is expensive.

It is an object of the invention to provide an apparatus of the kind specified which enables flat component strips to be produced inexpensively and with the minimum use of technical equipment.

According to the invention this problem is solved by disposing the slitting shears which slit the metal strip into component strips between the sets of tensioning drums. Preferably the apparatus also includes a stretch flattening or straightening unit disposed between the sets of tensioning drums. In this case the slitting shears are disposed between the inlet side set of tensioning drums and the straightening unit.

Since according to the invention slitting is performed during stretching tension and/or prior to passage through the stretch straightening unit, the stresses in each component strip produced by slitting are compensated, so that each strip is flat. Moreover, by the stretch flattening or stretch-bend flattening between the two sets of tensioning drums, which is performed with overstretching of the metal strip, the lengths of the individual component strips are equalized, since each strip is treated individually. In the apparatus according to the invention the shorter component strips which normally occurs in conventional installations are more heavily stretched than the longer component strips which would occur in conventional installations. This length equalization facilitates coiling on the recoiler with even tensile stress.

An embodiment of the invention will now be described in greater detail with reference to the single drawing, which is a diagrammatic side elevation of the apparatus of the invention for stretch flattening and longitudinal slitting.

The attached FIGURE is a schematic side view of the apparatus of the present invention.

Referring now in more detail to the drawing, a metal strip 1 to be stretch flattened and longitudinally slit into component strips is wound on a coiler 2. The strip 1 is drawn off of the coiler by an inlet side set of tensioning drums 3, 4 and passes to slitting shears 5, comprising a number of circular blades disposed one beside the other on opposite sides of the strip 1 which slit the strip longitudinally into component strips 10. The component strips are then passed, to a flattening or strightening unit 6. Edges 7 of the metal strip parted by the outer slitting blades are chopped into short pieces by a chopper 8 and fed to a scrap-collecting container 9. From the straightening unit 6, the component strips 10 pass via a set of outlet side tensioning drums 11, 12 to a recoiler 13. Between the coiler 2 and the inlet side set of tensioning drums 3, 4 on the one hand, and the output side set of tensioning drums 11, 12 and the recoiler 13 on the other, the metal strip 1 and the component strips 10 must be kept at a certain tension, so that the necessary tensile stress can be applied by the sets of tensioning drums 3, 4; 11, 12 to the metal strip 1 and the component strips 10 over the distance between the two sets of tensioning drums 3, 4; 11, 12.

The special advantages of the invention are the flat component strips 10 are obtained inexpensively and with the minimum use possible of technical apparatus. No longer, as previously, is the metal strip 1 itself stretch flattened, but rather the individual component strips are stretch flattened. Since the slitting shears 5 are disposed immediately upstream of the stretch flattening unit, no special guiding system is required for the component strips 10. Due to the simultaneous stretch flattening of the component strips 10 which are guided in parallel through the apparatus, the strips acquire an identical length having regard to their individual stresses.

We claim:

1. An apparatus for the stretch flattening and longitudinal slitting of a metal strip into component strips comprising an inlet set of tensioning drums for the metal strip and an outlet set of tensioning drums for the component strips, the drums of said outlet set being common to all of the component strips, said metal strip and component strips being guided over the drums and coupled to the drums such that said sets of tensioning drums apply tension to said strips which exceeds the tensile yield strength of the strips to overstretch and permanently elongate the metal strip and component strips; slitting shears disposed between the sets of tensioning drums for slitting the metal strip completely into said component strips while the strips are being permanently overstretched; and a recoiler for receiving the component strips from the outlet set of tensioning drums.

2. An apparatus according claim 1 further comprising a stretch straightening unit disposed between the sets of tensioning drums, and wherein the slitting shears are disposed between the inlet set of tensioning drums and the stretch straightening unit.

3. An apparatus according to claim 1, wherein the drums of each of said sets of tensioning drums are arranged to reverse a direction of travel of a strip by guiding the strip along an S-shaped path in order to apply tension and overstretch and elongate the metal strip and component strips.

4. An apparatus for the stretch flattening and longitudinal slitting of a metal strip into component strips, the apparatus having an inlet for the metal strip and an outlet for the component strips, the apparatus comprising first tensioning means disposed at said inlet for receiving the metal strip; second tensioning means disposed at said outlet for receiving said component strips, said first and second tensioning means being arranged to apply tension to the metal strip and component strips which is greater than the tensile yield strength of the strips to overstretch and permanently elongate said strips therebetween, said second tensioning means comprising an element common to the component strips; and slitting means disposed between said first and second tensioning means for slitting the metal strip completely into said component strips while the strips are being permanently overstretched.

5. An apparatus according to claim 4 further comprising a straightening unit disposed between said first and second tensioning means, and wherein said slitting means is disposed between said first tensioning means and said straightening unit.

6. An apparatus according to claim 4, wherein said first and second tensioning means comprise, respectively, first and second sets of tensioning drums.

7. An apparatus according to claim 4, wherein said slitting means comprises a plurality of circular slitting blades disposed one beside another on opposite sides of the metal strip.

8. An apparatus according to claim 4, wherein said first and second tensioning means are arranged to reverse a direction of travel of a strip by guiding a strip along an S-shaped path to overstretch and elongate the metal strip and component strips.

* * * * *